US009406454B2

(12) United States Patent
Hoepfl et al.

(10) Patent No.: US 9,406,454 B2
(45) Date of Patent: Aug. 2, 2016

(54) ARRANGEMENT OF VACUUM SWITCHING TUBES IN A LOAD TRANSFER SWITCH

(71) Applicants: Klaus Hoepfl, Maxhuette-Haidhof (DE); Silke Wrede, Zeitlarn (DE); Christian Kotz, Schorndorf (DE)

(72) Inventors: Klaus Hoepfl, Maxhuette-Haidhof (DE); Silke Wrede, Zeitlarn (DE); Christian Kotz, Schorndorf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/389,099

(22) PCT Filed: Apr. 8, 2013

(86) PCT No.: PCT/EP2013/057276
§ 371 (c)(1),
(2) Date: Sep. 29, 2014

(87) PCT Pub. No.: WO2013/174568
PCT Pub. Date: Nov. 28, 2013

(65) Prior Publication Data

US 2015/0068877 A1 Mar. 12, 2015

(30) Foreign Application Priority Data

May 22, 2012 (DE) ..... 10 2012 104 378

(51) Int. Cl.
*H01H 9/00* (2006.01)
*H01H 3/42* (2006.01)

(52) U.S. Cl.
CPC ..... *H01H 9/0027* (2013.01); *H01H 3/42* (2013.01); *H01H 9/0038* (2013.01)

(58) Field of Classification Search
CPC . H01H 9/0005; H01H 9/0027; H01H 9/0038; H01H 33/666; H01H 9/004; H01H 9/0016; H01H 9/0011; H01H 2033/6665; H01H 19/60; H01H 3/42
USPC ..... 218/120, 140, 153; 200/11 TC
See application file for complete search history.

(56) References Cited

U.S. PATENT DOCUMENTS

| | | | | |
|---|---|---|---|---|
| 5,191,179 A * | 3/1993 | Yatchum | ..... | H01H 9/0027 200/11 TC |
| 5,594,223 A | 1/1997 | Fukushi | | |
| 6,060,669 A * | 5/2000 | Dohnal | ..... | H01H 9/0038 200/11 TC |
| 2012/0139510 A1 | 6/2012 | Wrede | | |

FOREIGN PATENT DOCUMENTS

DE 1917692 A 10/1970

OTHER PUBLICATIONS

Machine translation DE1917692 (Orig. doc. published Oct. 15, 1970).*

* cited by examiner

*Primary Examiner* — Renee S Luebke
*Assistant Examiner* — William Bolton
(74) *Attorney, Agent, or Firm* — Andrew Wilford

(57) ABSTRACT

Arrangement of vacuum switching tubes (3, 3*a*, 3*b*) in a load transfer switch (1), wherein in each case one cam controller (5) comprising a control cam (7) and a lever bearing (10) for operating a moving contact (13) is associated with in each case one of the vacuum switching tubes (3, 3*a*, 3*b*), wherein at least one camshaft (15*a*, 15*b*) is arranged axially parallel to a drive shaft (11) and can be driven by means of said drive shaft, and wherein each axis (A) of the moving contact (13) of each vacuum switching tube (3, 3*a*, 3*b*) is arranged perpendicular to an axis (E) of the respective camshaft (15*a*, 15*b*).

7 Claims, 4 Drawing Sheets

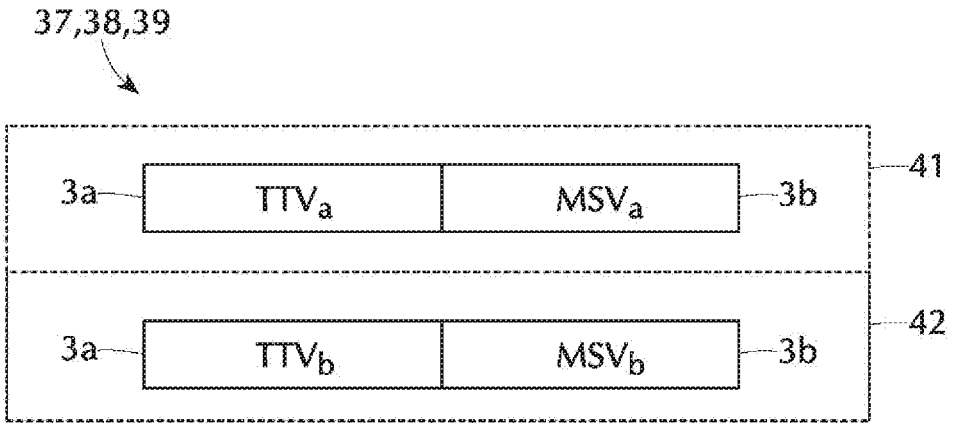
FIG. 2
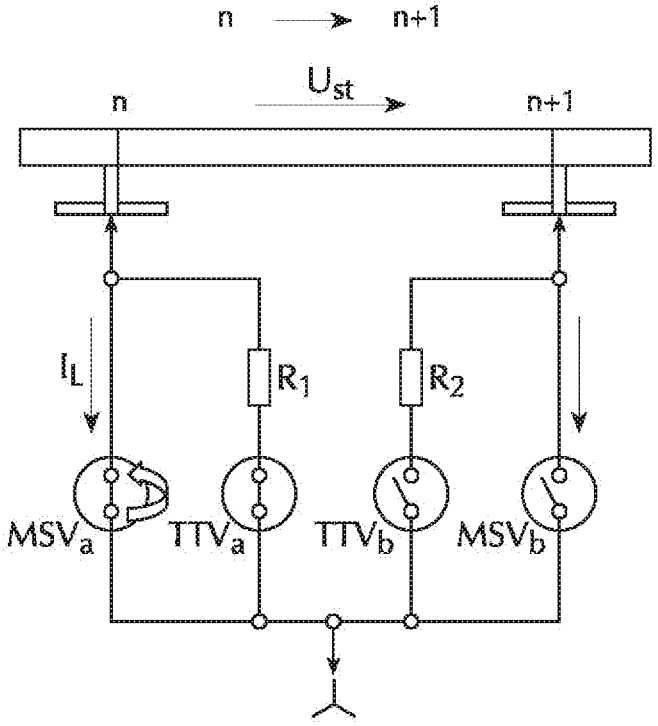
FIG. 3 - Prior Art

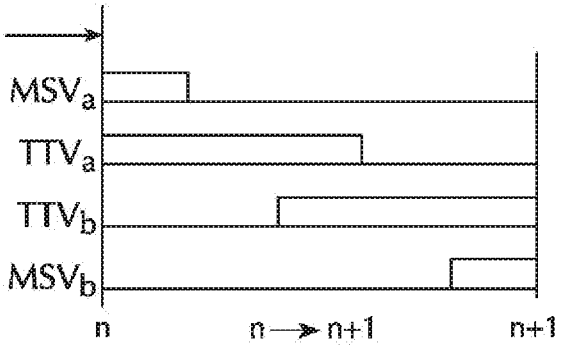
FIG. 4 - Prior Art
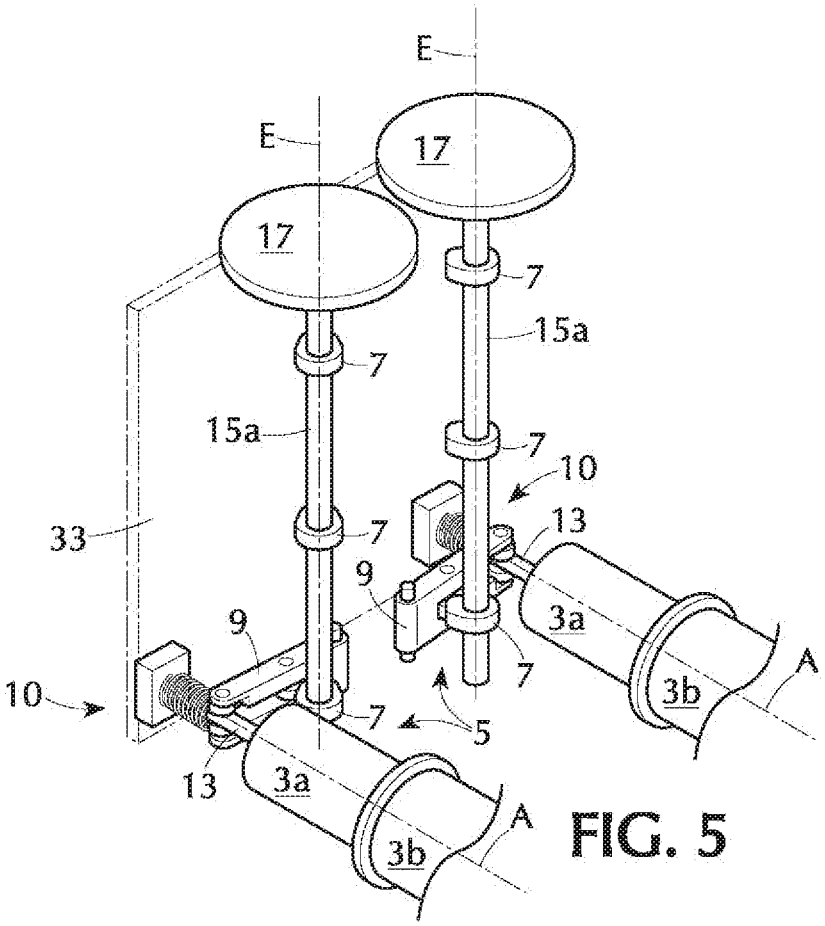
FIG. 5

ARRANGEMENT OF VACUUM SWITCHING TUBES IN A LOAD TRANSFER SWITCH

CROSS REFERENCE TO RELATED APPLICATIONS

This application is the US-national stage of PCT application PCT/EP2013/057276 filed 8 Apr. 2013 and claiming the priority of German patent application 102012104378.7 itself filed 22 May 2012.

FIELD OF THE INVENTION

The present invention relates to vacuum interrupters in a load-changeover switch. A respective cam controller consisting of a control cam and a lever assembly for actuation of a respective movable contact is provided with each of the vacuum interrupters.

BACKGROUND OF THE INVENTION

Load-changeover switches of the kind described in the introduction are incorporated in on-load tap changers and serve for successive, rapid and uninterrupted switching over from the connected winding tap to the new, preselected winding tap. The entire on-load tap changer is actuated by a motor drive for the changeover. A rotating drive shaft continuously moves a selector and at the same time a force-storage unit of the load-changeover switch is loaded. The selector serves for power-free selection of the respective new winding tap of the transformer that is to be switched to.

In the case of the described load changeover the load-changeover switch executes a specific switching sequence, i.e. different switch contacts and resistance switchss are actuated in a specific succession in time in succession or with an overlap. The switch contacts in that case serve for direct connection of the respective winding tap with the load diverter and the resistance switchss for temporary connection, i.e. bridging over by means of one or more switch-over resistances. Vacuum interrupters are advantageously used as switching elements for the load changeover. This is due to the fact the use of vacuum interrupters for the load changeover prevents formation of arcs in the oil and thus oil contamination of the oil in the load-changeover switch.

A load-changeover switch of that kind is disclosed in German published specification DE 10 2009 043 171 [US 2012/0139510]. Here, the load-changeover switch carries a drive shaft with at least one cam disc. The cam disc has several control cams, wherein two control cams arranged at the cam disc at the end have a profile, which departs from a circular shape, in the form of lobes at each of which a respective roller, which is connected by way of a rocker with a vacuum interrupter and the profile contour of which scans the respective control cam, is guided with maintained contact.

OBJECT OF THE INVENTION

The invention has the object of creating a space-saving and simple arrangement of vacuum interrupters in a load-changeover switch that ensures a rapid and individually adaptable load changeover.

SUMMARY OF THE INVENTION

This object is fulfilled by an arrangement comprising a respective cam controller that comprises a control cam and a lever assembly. Each control cam is, for actuation of a movable contact, associated with a respective one of the vacuum interrupters. The arrangement according to the invention is distinguished by the fact that at least one camshaft is arranged axially parallel to a drive shaft and is drivable thereby. In that case, each axis of the movable contact of each vacuum interrupter is perpendicular to an axis of the respective camshaft.

According to one embodiment the at least one camshaft and the drive shaft are so arranged that the drive of the at least one camshaft is through a gear that is seated at an upper end of the drive shaft, and a gear that co-operates therewith, of the at least one camshaft.

It will be obvious to the expert that other mechanical transmissions are also conceivable, since various machine elements for transmission between two arrangements, i.e. pairing of two gears, are disclosed in the prior art. It is additionally conceivable for the gear of the drive shaft to be seated not on an end of the drive shaft. The gear can be seated at any desired position along the drive shaft. The sole constructional precondition is that the gears of the camshafts have to be in operative connection with the gear on the drive shaft.

In order to realize the above-described actuation of a movable contact of a vacuum interrupter each camshaft has at least one control cam. Thus, the at least one camshaft, which is driven by the drive shaft, with at least one control cam rotates about its own axis, in particular in such a manner that the at least one control cam actuates the lever assembly. The lever assembly comprises a compression spring and a lever, such as, for example, a rocker switch, i.e. the control cam actuations the lever in such a way that, for example, via a rocking movement of the lever the compression spring mechanically coupled therewith actuations (opens) the movable contact in opposite direction of a vacuum interrupter.

In a first embodiment the vacuum interrupters are arranged along a line, i.e. a camshaft has several control cams, wherein each control cam actuates, via a lever assembly, a movable contact of a respective one of the vacuum interrupters. Thus, for example, a camshaft with three control cams can actuate three vacuum interrupters. In that case, the orientation of the control cams at the camshaft can also be differently designed. Thus, control cams of the same orientation can actuate simultaneously, and control cams with offset orientation at a cam shaft can actuate with an offset, the vacuum interrupters by the same stroke or different stroke.

In a second embodiment the vacuum interrupters are arranged in the form of a matrix, i.e. at least two camshafts each actuate at least one respective vacuum interrupter. For preference the at least one two camshafts have a plurality of control cams, so that even in the form of a matrix several vacuum interrupters are arranged along a line. A fast and individually adaptable load changeover is thus possible by virtue of the plurality of actuatable vacuum interrupters.

A further embodiment provides that a respective first vacuum interrupter and a respective second vacuum interrupter are connected together in such a manner that the two movable contacts of the first vacuum interrupter and the second vacuum interrupter are oriented oppositely to one another, and the axis of the movable contact of the first vacuum interrupter is perpendicular to the axis of the at least one first camshaft and the axis of the movable contact of the second vacuum interrupter is perpendicular to the axis of the at least one second camshaft of the movable contact.

Thus, one embodiment provides that arranged between the first vacuum interrupter and the second vacuum interrupter is a mounting plate with which the first and second vacuum interrupters are connected by material bond. A second embodiment provides that the first vacuum interrupter and the second vacuum interrupter are directly connected together by material bond. For preference, the first vacuum interrupter mounting plate or the second vacuum interrupter are glued together. It is obvious that also any form of connection known from the prior art can be used for the invention.

In a preferred embodiment the first vacuum interrupters and the second vacuum interrupters are arranged in the form of a matrix. In addition, at least two first camshafts and at least two second camshafts are provided, wherein the axes of the respective camshafts are arranged parallel to a common drive shaft.

An advantage in the case of the arrangement in accordance with the invention of vacuum interrupters at a load-changeover switch consists in that by virtue of a matrix arrangement of vacuum interrupters a space-saving and simple arrangement for a load-changeover switch is created.

A further advantage of the arrangement according to the invention is that several vacuum interrupters can be actuated simultaneously and/or with an offset and with the same stroke or different strokes. A rapid and individually adaptable load changeover is thus possible.

BRIEF DESCRIPTION OF THE DRAWING

The invention and the advantages thereof are described in more detail in the following with reference to the accompanying drawings, in which:

FIG. 2 is a schematic illustration of one of three phases of the load-changeover switch;

FIG. 3 is a circuit diagram of a switching course that four vacuum interrupters run through in a respective phase according to FIG. 2;

FIG. 4 shows the switching sequence of the switching course according to FIG. 3;

FIG. 5 is a perspective view of a cam controller for actuation of a movable contact of each vacuum interrupter according to FIG. 1;

SPECIFIC DESCRIPTION OF THE INVENTION

Figure 1:
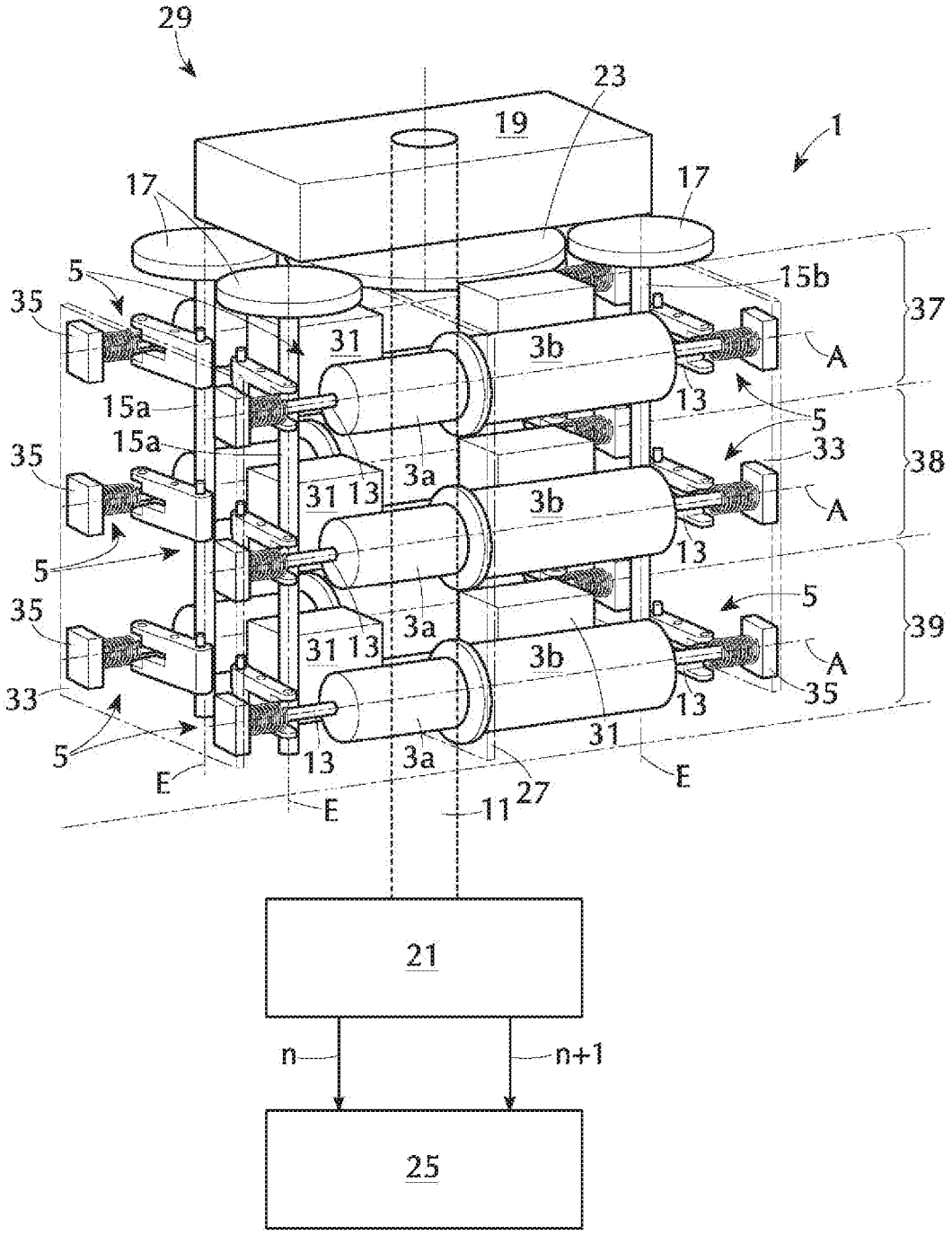
FIG. 1 is a perspective view of an embodiment of the invention with vacuum interrupters in the form of a matrix at a load-changeover switch.

Identical reference numerals are used in the figures for the same or equivalent elements of the invention. Moreover, for the sake of clarity the individual figures show only reference numerals that are required for description of the respective figure.

FIG. 1 is a perspective view of a preferred embodiment of the invention with twelve vacuum interrupters 3*a*, 3*b* in a load-changeover switch 1. The load-changeover switch 1, which is part of an on-load tap changer 29, effects changeover from the connected winding tap n to the respective preselected winding tap n+1. The entire on-load tap changer 29 is actuated by a motor drive for the changeover. A rotating drive shaft 11 continuously moves a selector 21 and at the same time a force-storage unit 19 of the load-changeover switch 1 is loaded. The selector 21 serves for power-free selection of the respective new winding tap of a transformer 25 that is to be switched to. When the force-storage unit 19 is completely loaded it is unlatched and abruptly releases its energy and actuates the load-changeover switch 1 in the millisecond range by the drive shaft 11.

Figure 6:
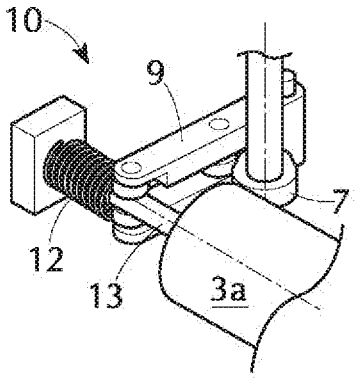
FIG. 6 is an enlarged perspective view of a lever assembly of the cam controller according to FIG. 5.

As already described, the load-changeover switch 1 comprises twelve vacuum interrupters 3*a*, 3*b*, and respective cam controllers 5 each comprising a control cam 7 and a lever assembly 10 (see FIGS. 5, 6 and 7) and is, for actuation of a respective movable contact 13, associated with a respective one of the first and second vacuum interrupters 3*a*, 3*b*.

According to the invention the twelve vacuum interrupters 3*a*, 3*b* are arranged in a matrix. Since the load-changeover switch 1 has three phases 37, 38, 39 each of the three phases 37, 38, 39 has four vacuum interrupters 3*a*, 3*b*. The four vacuum interrupters 3*a*, 3*b* of each phase 37, 38, 39 are divided into two first vacuum interrupters 3*a* and two second vacuum interrupters 3*b*, and first vacuum interrupter 3*a* and the second vacuum interrupter 3*b* of each phase 37, 38, 39 form a respective first load branch 41 and second load branch 42. This is schematically illustrated in FIG. 2.

The first load branch 41 has the respective second vacuum interrupter 3*b* that acts as a main switch MSVa, as well as the respective first vacuum interrupter 3*a* that acts as resistance switch TTVa. The second load branch 42 analogously has a second vacuum interrupter 3*b* acting as main switch MSVb and a first vacuum interrupter 3*a* acting as resistance switch TTVb.

FIG. 3 is a circuit diagram of a switching course that four vacuum interrupters 3*a*, 3*b* run through in a respective phase 37, 38, 39 according to FIG. 2.

FIG. 4 shows the switching sequence of the switching course in the case of changeover from the winding tap n to the winding tap n+1. The initial position, in which the tap is connected, corresponds with the setting, which is illustrated in FIG. 3, of the individual switching elements. The changeover takes place in the following steps: MSVa opens, TTVb closes, TTVa opens and MSVb closes. The changeover is concluded.

The load-changeover switch 1 according to FIG. 1 thus has, in total, six second vacuum interrupters 3*b* acting as main switchs MSV and six first vacuum interrupters 3*a* acting as resistance switchs TTV. In addition, two first camshafts 15*a* and two second camshafts 15*b* (in this perspective view only one second camshaft 15*b* is visible) are arranged axially parallel to the drive shaft 11 and are drivable thereby. In that case, an axis A of each movable contact 13 of each first and second vacuum interrupter 3*a*, 3*b* is perpendicular to an axis E of the first and second camshafts 15*a*, 15*b*. However, it is also conceivable for further forms of embodiment to have a lesser or greater number than six first and second vacuum interrupters 3*a*, 3*b* and two first and second camshafts 15*a*, 15*b*.

In the embodiment shown here, in particular, in each instance the first vacuum interrupter 3*a* and the second vacuum interrupter 3*b* are so connected together that the two respectively associated movable contacts 13 of the first vacuum interrupter 3*a* or second vacuum interrupter 3*b* are oriented oppositely, wherein the axes A of the movable contact 13 of the first vacuum interrupters 3*a* are perpendicular to the axis E of the two camshafts 15*a* and the axes A of the movable contact 13 of the second vacuum interrupters 3*b* are perpendicular to the axis E of the two second camshafts 15*b* of the movable contact 13.

For connection of each first vacuum interrupter 3*a* with a second vacuum interrupter 3*b*, also termed tandem interrupters, a mounting plate 27 is here arranged between the first and second vacuum interrupters 3*a*, 3*b*. In that case, each first and second vacuum interrupter 3*a*, 3*b* is connected by a material-coupling connection, such as, for example, gluing, with the mounting plate 27.

The arrangement and drivability of the first and second camshaft 15*a*, 15*b* by way of the drive shaft 11 is in that case preferably designed in such a manner that in accordance with the embodiment illustrated here a gear 23 is arranged at an upper end of the drive shaft 11 and a respective gear 17 is arranged at an upper end of each of the first and second camshafts 15*a*, 15*b*, so that each gear 17 of the first and second camshafts 15*a*, 15*b* co-operates with the gear 23 of the drive shaft 11.

In order to realize actuation of a movable contact 13 of the first and second vacuum interrupters 3*a*, 3*b*, each first and second camshaft 15*a*, 15*b* has at least one control cam 7 (see, for that purpose, FIG. 5). By means of the drive shaft 11 the first and second camshafts 15*a*, 15*b* rotate about the individual axis E and thus entrain the at least one control cam 7. The at least one control cam 7 thus actuates a respective lever assembly 10 (see, for that purpose, the description with respect to FIG. 5 and FIG. 6).

Moreover, the arrangement according to the invention of first and second vacuum interrupters 3*a*, 3*b* for a load-changeover switch 1 provides further elements such as, for example, switch-over resistances 31 for the first and second vacuum interrupters 3*a*, 3*b*, external mounting plates 33 for the arrangement of the elements in a load-changeover switch 1, and spring mountings 35 for compression springs 12 (see FIG. 6), which overall are self-explanatory, for which reason a more detailed description of these elements was dispensed with here.

FIG. 5 is a perspective view of a cam controller 5 for actuation of a movable contact 13 of in each instance the one of the two first vacuum interrupters 3*a* according to FIG. 1. Each cam controller comprises a first vacuum interrupter 3*a*, a lever assembly 10 and a control cam 7. In the embodiment shown here each first camshaft 15*a* has three control cams 7. Other forms of embodiment can also provide a greater a lesser number of control cams 7 at a cam shaft 15*a*, 15*b*. Each lever assembly 10, illustrated to enlarged scale in FIG. 6, comprises a compression spring 12 and a rocker switch as a lever 9. The control cam 7 rotatable with the first camshaft 15*a* actuates the lever 9 of the lever assembly 10 so that by way of a rocking movement of the lever 9 the compression spring 12 mechanically coupled therewith actuates the movable contact 13 in the direction of the first vacuum interrupters 3*a*.

As already described in the embodiment of FIG. 1 the first vacuum interrupters 3*a* and the second vacuum interrupters 3*b* are connected together by way of a mounting plate 27. In the embodiment shown here the first vacuum interrupters 3*a* and the second vacuum interrupters 3*b* are connected together by material couple.

Figure 7:
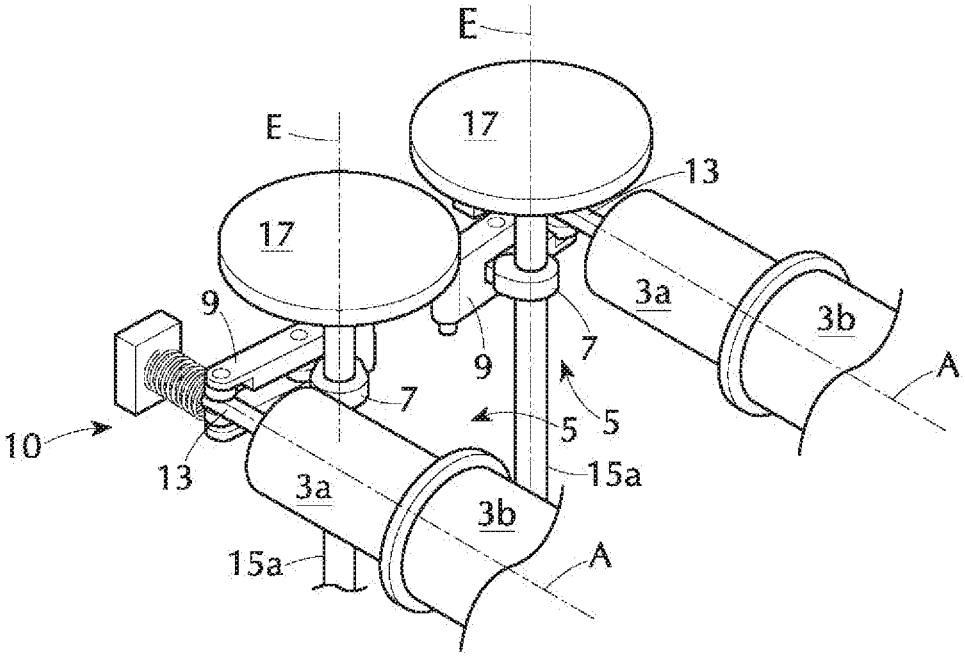
FIG. 7 is a further perspective view of the cam controller according to FIG. 1 and FIG. 5.

FIG. 7 is a further perspective view of the cam controller 5 according to FIGS. 1 and 2. All elements are already described in FIGS. 1 and 5.

Figure 8:
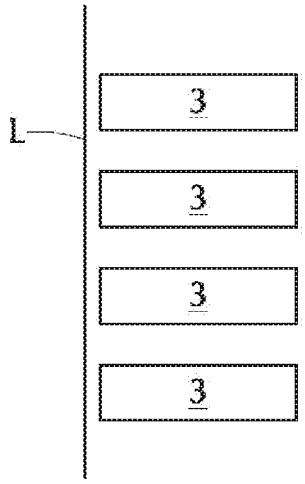
FIG. 8 is a schematic illustration of one possibility of the arrangement of vacuum interrupters.

FIG. 8 is a view of four vacuum interrupters 3 that are arranged along a line L. Thus, a camshaft 15*a* or 15*b* (see, for that purpose, FIG. 1) has four control cams 7 (see, for that purpose, for example FIG. 5), wherein each control cam 7 actuates by way a lever assembly 10 (see FIG. 6) a movable contact 13 (see, similarly, FIG. 1 or 5) of a respective one of the four vacuum interrupters 3. Thus, one camshaft 15*a* or 15*b* with four control cams 7 can actuate four vacuum interrupters 3. In that case, the orientation of the control cams 7 at the camshaft 15*a* or 15*b* can also be designed to be different. Thus, control cams 7 with the same orientation can actuate simultaneously, and control cams 7 oriented at a camshaft 15*a* or 15*b* with an offset, can actuate with an offset the vacuum interrupters 15*a* or 15*b* by the same stroke or different strokes.

The invention was described with reference to preferred forms of embodiment. However, it is obvious to any expert that modifications and changes can be undertaken without in that case departing from the scope of protection of the appended claims. The embodiments explained beforehand serve merely for description of the claimed teaching, but do not restrict this to the embodiments.

The invention claimed is:

1. A load-changeover switch comprising:

a first vacuum interrupter having a contact movable along a contact axis;

a second vacuum interrupter having a contact also movable along the contact axis;

a drive shaft extending along a shaft axis perpendicular to the contact axis;

respective first and second camshafts driven by the drive shaft and extending along camshaft axes perpendicular to the contact axis and carrying at the first and second vacuum interrupters respective first and second cams; and respective first and second lever assemblies engaged between each of the cams and the respective contact.

2. The load-changeover switch according to claim 1, wherein the camshafts each carry a gear that meshes with a gear of the drive shaft.

3. The load-changeover switch according to claim 1, wherein the vacuum interrupters are arranged along a line.

4. The load-changeover switch according to claim 1, wherein the vacuum interrupters are arrayed in a matrix.

5. The load-changeover switch according to claim 1, further comprising:

a mounting plate between the first vacuum interrupter and the second vacuum interrupter with which the first and second vacuum interrupters are integrally connected.

6. The load-changeover switch according to claim 1, wherein the first vacuum interrupter and the second vacuum interrupter are integrally connected.

7. The load-changeover switch according to claim 1, wherein the first vacuum interrupter and the second vacuum interrupters are arranged in the form of a matrix and that at least two first camshafts and at least two second camshafts are provided whose axes are parallel to the drive shaft.

* * * * *